US005118213A

United States Patent [19]

Meservy et al.

[11] Patent Number: 5,118,213

[45] Date of Patent: Jun. 2, 1992

[54] DEMOUNTABLE WRITING TABLE FOR A NOTEBOOK

[76] Inventors: Jay A. Meservy, 564 Pheasant Cir., Bountiful, Utah, 84010; Jerry D. Meservy, 692 S. 850 East, Centerville, Utah 84014

[21] Appl. No.: 751,299

[22] Filed: Aug. 28, 1991

Related U.S. Application Data

[63] Continuation-in-part of Ser. No. 532,050, Jun. 1, 1990, Pat. No. 5,044,807.

[51] Int. Cl.[5] ..... B42F 13/00

[52] U.S. Cl. ..... 402/80 R; 248/454; 402/73

[58] Field of Search ..... 402/73, 74, 75, 76, 402/77, 78, 79, 80 R, 50 L, 502; 248/454, 459

[56] References Cited

U.S. PATENT DOCUMENTS

| | | | |
|---|---|---|---|
| 1,840,743 | 1/1932 | Schade | 402/80 R |
| 3,136,082 | 6/1964 | Sloves | 402/73 X |
| 3,936,202 | 2/1976 | Brajituli | 402/80 R X |
| 4,019,823 | 4/1977 | Kleinert et al. | 402/80 R X |
| 4,603,995 | 8/1986 | Vilona | 402/80 R X |
| 4,623,276 | 11/1986 | Kinneir | 402/80 R X |
| 4,981,386 | 1/1991 | Beleckis | 402/73 |

*Primary Examiner*—Paul A. Bell
*Attorney, Agent, or Firm*—J. Winslow Young

[57] ABSTRACT

A writing platform for a notebook, the writing platform including a writing table that can be elevated from a flat configuration to an elevated position along one edge adjacent the ring binder of the notebook so as to provide a slanted writing surface underneath one or more pages in the notebook. A riser is hingedly joined to the writing table and supports the edge of the writing table at a preselected elevation. Engagement means are included on the riser element and are used to releasably engage the rings of the ring binder to releasably support the writing table in a generally wedge-like orientation. The dimensional characteristics of the riser and the engagement means on the riser determine the elevation of the edge of the writing table.

13 Claims, 3 Drawing Sheets

DEMOUNTABLE WRITING TABLE FOR A NOTEBOOK

RELATED APPLICATIONS

This application is a continuation-in-part application of our copending application Ser. No. 07/532,050 filed 1 June 1990 for ADJUSTABLE WRITING PLATFORM FOR A NOTEBOOK. Now U.S. Pat. No. 5,044,807.

BACKGROUND

1. Field of the Invention

This invention relates to notebook accessories and, more particularly, to a demountable writing platform apparatus and method for selectively elevating the edge of the pages adjacent the ring binder of a looseleaf notebook.

2. The Prior Art

Notebooks of various looseleaf varieties have been known for decades. These notebooks are used for numerous purposes although the primary purpose, as the name "notebook" implies, is that of recording handwritten notes. One especially popular form of looseleaf notebook is a personal calendar/notebook combination commonly referred to as a "day planner". The usual format for a day planner is that it includes a separate page for each day of the year with each page segregated into hourly blocks along with an area for the recordation of notes, reminders, expenditures, and the like. A separate section of the day planner includes a series of alphabetically arranged pages for use as a directory.

Clearly, the inherent value of such a looseleaf notebook is through regular usage by the owner. This means that the person using the looseleaf notebook should write in the notebook on a regular basis. However, it is well known that a notebook with a substantial number of pages represents a difficult writing surface due to the inherent nature of the looseleaf notebook. In particular, the pages held by the ring binder will vary greatly in thickness depending upon which page is to be written upon and also which side of the particular page is being used. These problems are particularly exacerbated by the fact that day planners are specifically configured to be as compact as possible for purposes of handling convenience. The result is that considerable distortion of the pages is encountered making writing on them particularly awkward. Further, depending upon which side of the page is being written upon and the thickness of the total number of pages underneath this particular page, writing in a notebook is quite cumbersome to the extent that many people become discouraged and do not write in the day planner as much as they should.

Perhaps the most serious difficulty is encountered when the writer must place his or her writing hand across the rings of the ring binder of the notebook in order to write on the pages opposite the writing hand. This is particularly troublesome for persons who write left handed on the right side of the notebook because of the nature of the hand position assumed while writing. Customarily, the left-handed person holds the writing hand above the area being written upon. The fingers holding the writing implement are curved downwardly toward the wrist. This writing position is assumed by the writer to enable the writer to be able to visually observe what is being written. In other words, the left-handed writer writes on a page from above which means that the forearm and wrist, at the minimum, are forced to contend with the ring binder while writing on the right side of the page. Correspondingly, the person writing with the right hand on the left side of the notebook encounters the ring binder with the right hand as the page is written on from left to right. This means that a person writing on a page in close proximity to the rings of the ring binder encounters interference with the writing hand or wrist being brought into proximity with the ring binder.

An alternative solution to these problems is to remove the particular page from the notebook and place it upon a separate, support surface for writing. This is awkward particularly if no suitable support surface is conveniently available. Further, opening the looseleaf binder to remove a specific page to be written upon momentarily releases the remaining pages so that they can become loose and even fall out of the notebook. Accordingly, a person who uses the day planner on a consistent basis is required to write on pages that are not adequately supported on a suitable writing surface.

Various prior art devices are known for use in combination with notebooks. One such device is that of Jackel (German Patent No. 329,002) which is directed to a page support system for a looseleaf notebook. The support system is used to elevate the outer edges of the pages above the inner edges apparently for the purpose of making the pages easier to read. Nothing in this reference is directed toward making the pages easier to be written upon.

Similar devices for elevating the outer edge of the pages are shown in the references of Sanabria (U.S. Pat. No. 4,880,327); Neilson (U.S. Pat. No. 2,309,474); and Elsden (German Patent No. 812,308).

Easel-type page support systems are shown by Jacobson (U.S. Pat. No. 4,240,761); Cirigliano (U.S. Pat. No. 3,091,482); and Gallo (French Patent No. 1,570,581).

Chinchar (U.S. Pat. No. 4,595,309) discloses a pad for a looseleaf notebook, the pad having an extended margin strip engageable with the rings of the looseleaf notebook.

In view of the foregoing it would be a significant advancement in the art to provide a writing table for pages in a looseleaf notebook. It would also be an advancement in the art to provide a demountable writing table for pages of a looseleaf notebook whereby the writing table can be removably engaged to at least a pair of rings of a ring binder to elevate the adjacent edge of the pages to be written upon. Removal from the ring binder will allow the writing table to be opened into a flat, relatively unobtrusive position for storage. Such a novel apparatus and method is disclosed and claimed herein.

BRIEF SUMMARY AND OBJECTS OF THE INVENTION

This invention involves a demountable, semirigid, writing table for looseleaf notebooks. The writing table provides a wedge-like support surface wherein the inner edge of the writing table adjacent the ring binder is elevated. The support surface provides an outwardly slanted writing table underneath the particular set of pages being written upon. The writing table is configured to be releasably mounted to the rings of the ring binder in the looseleaf notebook. A foldable riser for supporting the edge of the writing table adjacent the ring binder is releasably engageable to at least two rings of the ring binder. The outer edge of the writing table slopes downwardly to a position represented by the original position of the pages of the notebook prior to their being elevated by the writing table.

It is, therefore, a primary object of this invention to provide improvements in writing tables for looseleaf notebooks.

Another primary object of this invention is to provide improvements in the method of providing support to a page of a looseleaf notebook.

Another object of this invention is to provide a demountable writing table for a looseleaf notebook whereby a riser on the writing table can be releasably engaged to the ring binder to elevate and support the writing table and a page being written upon.

Another object of this invention is to provide a writing table for a notebook, the notebook having a ring binder with the writing table being selectively engageable on the ring binder to raise the writing table under the inner edge of the pages adjacent the ring binder.

Another object of this invention is to provide a writing table for selectively supporting pages to be written upon, the writing table being capable of being selectively engaged to the ring binder at more than one position.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENTS

The invention is best understood by reference to the following description taken in conjunction with the accompanying drawing wherein like parts are designated by like numerals throughout.

GENERAL DISCUSSION

The novel writing platform of this invention is designed to allow a person using a notebook to selectively elevate preselected pages adjacent the ring binder to a predetermined elevation so as to accommodate the user being able to easily write upon the top page so elevated. The writing platform is configured to elevate the pages adjacent the rings of the notebook in a wedge-like configuration to substantially eliminate interference by the rings. The overall configuration of the support is generally wedge-like when compared to the planar orientation of the open note book.

The material of construction for the writing platform can be any suitable material of construction such as plastic, cardboard, leather, or wood; although the preferred material is plastic due to its having sufficient stiffness in addition to its characteristics of being readily formable, available, and relatively inexpensive. While numerous suitable plastics, such as polyethylene, polycarbonate, and the like, are available, polypropylene has been found to exhibit the desired features of allowing the writing platform in its various embodiments to be readily fabricated by injection molding techniques.

DETAILED DESCRIPTION

Figure 1:
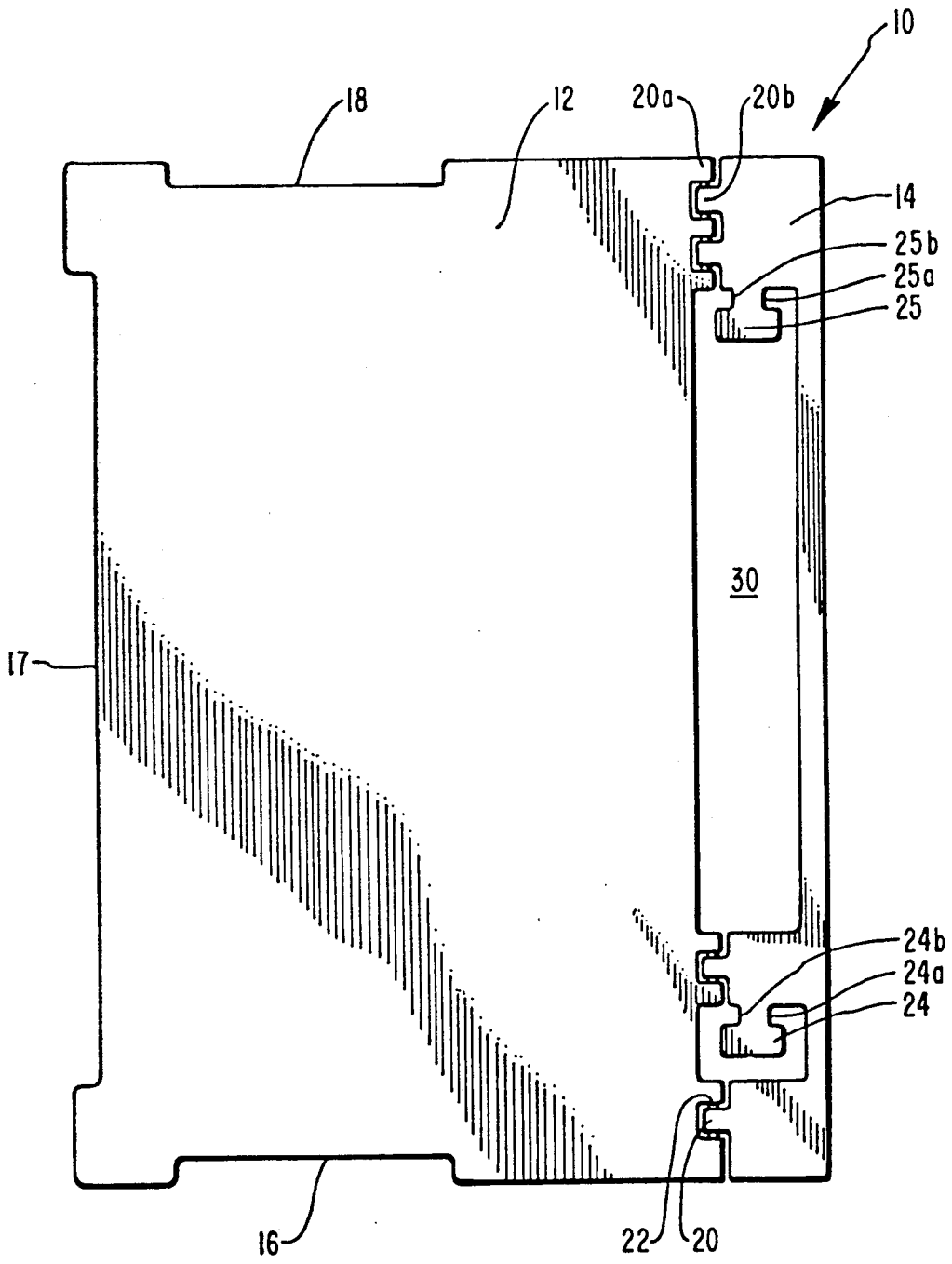
FIG. 1 is a plan view of a first preferred embodiment of the novel writing table of this invention.

Referring now to FIG. 1, the novel writing platform of this invention is shown generally at 10 and includes a writing table 12 hingedly joined to a riser 14 at a hinge 20. Hinge 20 is configured as a conventional hinge having a plurality of pivotally interlocking fingers 20*a* and 20*b*. Fingers 20*a* are formed as extensions of writing table 12 while fingers 20*b* are formed as extensions of riser 14. Fingers 20*a* and 20*b* engage a hinge pin 22 which serves as the pivot for hinge 20. Hinge pin 22 can be readily produced simultaneously with fingers 20*a* during injection molding of writing table 12. In this conventional configuration, fingers 20*b* are injection molded with a groove (not shown) that will engage pin 22 in a snap fit relationship so that riser 14 can be snapped in place into engagement with writing table 12.

Writing table 12 is fabricated from a suitable plastic material such as polyethylene, polycarbonate, polypropylene, or the like, or other suitable material of construction. Importantly, writing table 12 must be constructed from a material having sufficient rigidity to adequately support pages 66*a* (FIG. 3) elevated thereby. This is particularly important since writing table 12 must support the anticipated forces exerted thereon while pages 66*a* are being written upon by the operator (not shown). Fabrication of writing table 12 can be achieved by die cutting a sheet of plastic material or, alternatively, by injection molding techniques. The outline of writing table 12 includes peripheral cutout sections 16, 17 and 18, the function of which is to enable the operator to more easily grasp writing table 12 to place it in the desired position and/or orientation.

Figure 2:
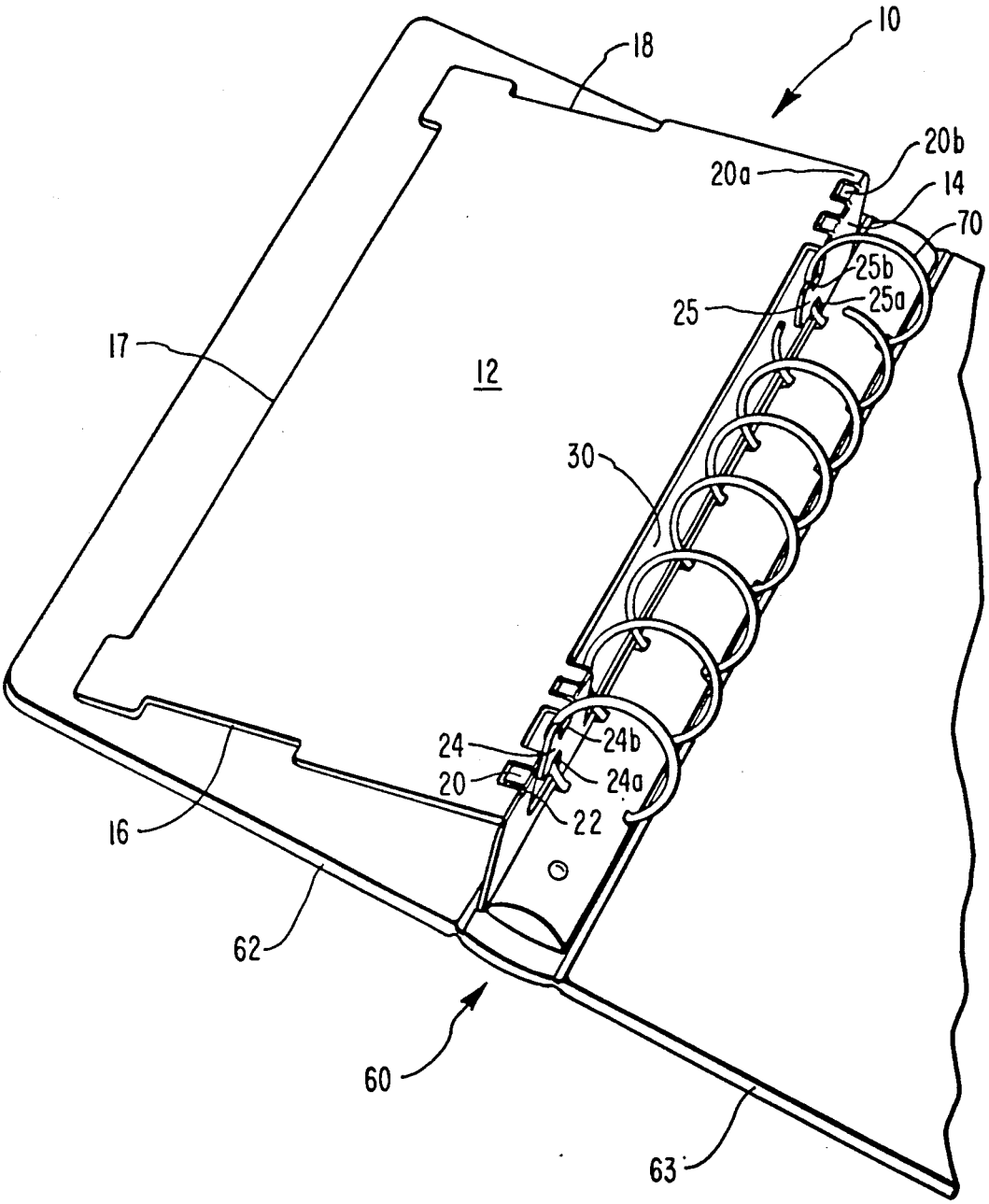
FIG. 2 is an a perspective view of the first preferred embodiment of the writing table of FIG. 1 shown in the environment of a looseleaf notebook, a portion of which has been broken away for ease of illustration.
Figure 3:
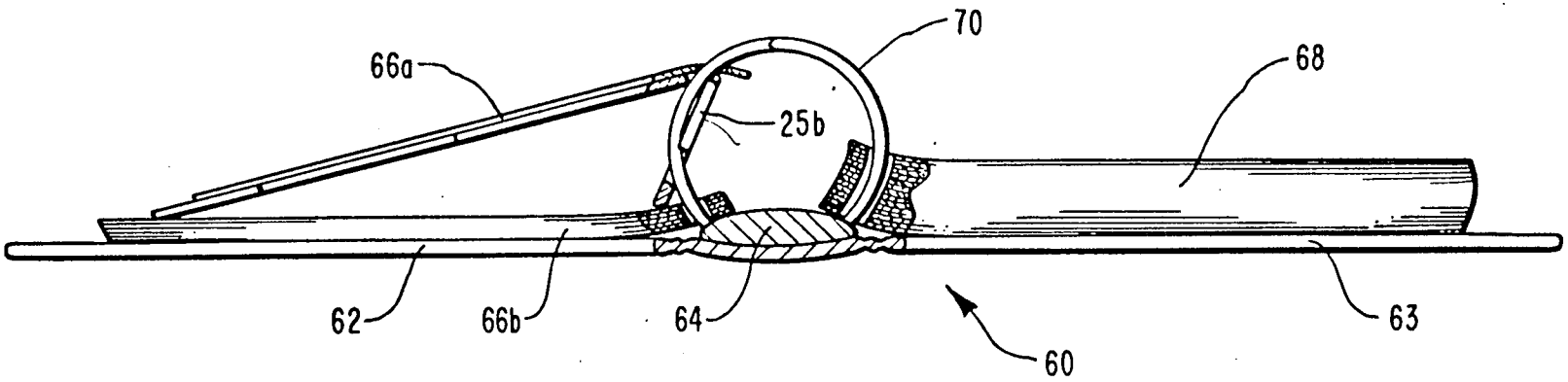
FIG. 3 is a end view of the writing table of this invention shown in the environment of the note book of FIG. 2 and in the environment of pages with portions shown broken away for ease in illustrating the interlocking relationship between the riser and the rings of the notebook.

Referring also to FIGS. 2 and 3, riser 14 is configured as a rigid element so as to provide the necessary degree of structural support to writing table 12 when the same is raised to the elevated position shown in FIGS. 2 and 3. A pair of fingers 24 and 25 are configured to releasably engage corresponding rings 70 of a ring binder 64. In particular, fingers 24 and 25 are designed to be received in the inside curvature of rings 70 while the main body of riser 14 is on the outside. In this manner, fingers 24 and 25 releasably engage riser 14 to rings 70 by forming a clip-like relationship with rings 70. A pair of detents 24*a* and 24*b* on finger 24 and a corresponding pair of detents 25*a* and 25*b* on finger 25 provide the interlocking relationship between the respective fingers 24 and 25 and the rings 70 to which they are engaged.

An opening 30 is provided between writing table 12 and riser 14 so as to provide a space into which the rings 70 that are not engaged by fingers 24 and 25 can be received. The spatial separation between fingers 24 and 2 along with the dimensions of opening 30 are selectively predetermined according to the specific dimensions of rings 70. Clearly, of course, a plurality of fingers similar to fingers 24 and 25 could be included in riser 14 so as to engage more than just two of rings 70 although it is presently preferred to have only two fingers, fingers 24 and 25, so as to provide greater flexibility in the use of writing platform 10 with a variety of types of rings 70 on ring binder 64.

Referring now particularly to FIG. 2, notebook 60 is shown partially broken away for ease of illustration and includes a front cover 62, a back cover 63, and a ring binder 64 which supports a plurality of rings 70. One of rings 70 adjacent finger 25 is shown broken away so as to reveal the relationship between the ring 70 engaged by finger 24 and finger 25. As shown, fingers 24 and 25 engage the respective rings of rings 70 and thereby support riser 14 in an elevated orientation. The intervening rings 70 are received in opening 30 in a noninterfering relationship with riser 14. Fingers 24 and 25 are easily mounted to the respective rings of rings 70 by simply raising riser 14 to an elevated position and bringing fingers 24 and 25 into the spatial separation between rings 70. Thereafter, fingers 24 and 25 are pulled across the respective rings 70 until detents **24*a* and 24*b* of finger 24 and detents 25*a* and 25*b* of finger 25 releasably engage the respective rings 70. In this manner riser 14 is releasably supported in the elevated position by rings 70. Correspondingly, writing table 12 is hingedly folded at hinge 20 so as to provide an elevated edge to writing table 12. The opposite edge of writing table 12 rests against the inside face of front cover 62** in a wedge-like relationship.

Advantageously, writing platform 10 can be demountably attached to rings 70 with writing table 12 in juxtaposition with front cover 62 or back cover 63. This is done by reversing the interrelationship between fingers 24 and 25 with rings 70. In particular, riser 14 is reversed end for end so that fingers 24 and 25 are pushed upwardly into engagement with rings 70 instead of downwardly as shown in FIG. 2. Writing table 12 is thereby positioned above back cover 63 to provide a writing support surface on the right side of notebook 60.

Referring now further to FIG. 3, notebook 60 is shown having, page **66*a* and pages 66*b* mounted to rings 70 on the left side with pages 68 on the right side. In this broken away view, finger 25 is shown engaged to ring 70 so as to support riser 14 in an elevated orientation. Importantly, riser 14 is shown engaged to ring 70 between page 66*a* and pages 66*b*. This is done to illustrate the versatility of the novel writing platform 10 of this invention to show that it can be mounted to rings 70 at any preselected location relative to any of page 66*a*, pages 66*b*, or pages 68. Further, writing platform 10 can be demounted from rings 70 and placed at any desired position relative to page 66*a*, pages 66*b*, or pages 68 and with respect to front cover 62 or back cover 63**.

THE METHOD

Writing platform 10 is specifically intended to be removable relative to notebook 60 and in the flattened configuration shown in FIG. 1 can be inserted into notebook 60 at any preselected location for storage. However, the most likely storage location for writing platform 10 will be in a pocket (not shown) customarily formed on an inner face of either front cover 62 or back cover 63. Advantageously, writing platform 10 is configured with a thickness that is only incrementally greater than that of page **66*a* so as to reduce the space occupied thereby. However, the thickness of writing table 12 as a function of its material of construction is sufficient to support normal forces generated when page 66*a*** is written upon.

Placement of writing platform 10 in notebook 60 with writing table 12 in the elevated position is accomplished by opening notebook 60 and selecting page **60*a* to be supported thereby. Writing platform 10 is placed under page 60*a* and riser 14 hinged downwardly from writing table 12 into a generally vertical orientation. Fingers 24 and 25 are snapped into engagement with rings 70 so as to demountably engage riser 14 to rings 70. As shown in FIG. 2, page 66*a* is supported by writing table 12 in a generally wedge-like orientation relative to front cover 62. However, it is important to note that the right edge of page 66*a* adjacent rings 70 is almost tangential to the circular profile of rings 70. In this manner, page 66*a* is supported above the major bulk of rings 70 thereby effectively eliminating potential interference between rings 70** and the writing hand (not shown).

What is claimed and desired to be secured by United States Letters Patent is:

1. A writing platform for a notebook having a ring binder comprising:

a writing table;

a riser joined to one edge of said writing table for elevating said edge of said writing table; and engagement means on said riser for releasably engaging rings of said ring binder and thereby simultaneously elevating said edge of said writing table adjacent said ring binder to provide said writing platform.

2. The writing platform defined in claim 1 wherein said writing table comprises a planar writing surface having a hinge formed along said edge of said writing table with said riser comprising a rigid element hingedly joined to said writing table at said hinge, said riser including said engagement means for engaging said rings of said ring binder with said riser elevating said edge incrementally relative to said ring binder.

3. The writing platform defined in claim 2 wherein said engagement means comprises a pair of spaced fingers on said riser, said fingers being spaced a predetermined distance so as to enable said riser to be removably mounted to said rings with said writing table supported by said riser, said riser thereby elevating said edge of said writing table at a predetermined angle and at an incremental elevation relative to said rings.

4. The writing platform defined in claim 3 wherein said engagement means comprises a rigid strip extending between said fingers, said rigid strip being spaced from said hinge and forming an opening, said opening receiving a portion of said rings of said ring binder, said portion of said rings comprising rings of said ring binder interposed between said rings engaged by said engagement means.

5. The writing platform defined in claim 4 wherein said fingers include detents for releasably engaging said rings engaged by said fingers.

6. A writing platform for a notebook having a ring binder comprising:

a riser element removably mountable to rings of said ring binder;

a writing table hingedly mounted to said riser element; and engagement means on said riser element for releasably engaging rings of said ring binder, said engagement means comprising a detent means for releasably supporting said riser element in a generally vertical orientation relative to said writing table.

7. The writing platform defined in claim 6 wherein said riser element and said writing table are formed from planar elements having a first side and a second side with said riser being formed as a strip hingedly joined on an edge at a hinge to said writing table, said writing table being folded at said hinge so as to be elevated above said riser element with said writing table forming a slanted writing surface.

8. The writing platform defined in claim 7 wherein said riser element comprises mounting means for releasably mounting said riser element to said rings of said ring binder, said mounting means comprising a pair of spaced detents in said riser element, said spaced detents being adapted to being engaged on a pair of correspondingly spaced rings of said ring binder of said looseleaf notebook.

9. The writing platform defined in claim 8 wherein said detent means comprises detents on said riser element for releasably engaging said rings with a spring-like action by the resiliency of the material of construction of said riser element.

10. A method for providing a writing platform in a notebook having a ring binder comprising:

forming a writing table as a planar surface;

preparing a riser element by forming a rigid strip having a pair of spaced, ring-engaging fingers, said fingers being configured to releasably engage a pair of correspondingly spaced rings of said ring binder;

hingedly joining said riser element to writing table along an edge, the width of said riser element determining the distance said edge of said writing table can be elevated by said riser element; and mounting said riser element in said notebook by engaging said rings with said fingers.

11. The method defined in claim 10 wherein said forming step and said preparing step comprise fabricating each of said writing table and said riser element from a planar element with a hinge between said riser element and said writing table, said hinge folding said riser element below said writing table thereby elevating said hinge.

12. The method defined in claim 10 wherein said elevating step comprises providing detent means on said fingers for releasably supporting said riser element on said rings.

13. The method defined in claim 12 wherein said providing step comprises forming said fingers in said riser element for releasably engaging said riser element to said rings, said riser element thereby supporting said edge of said writing table.

* * * * *